US009368876B2

(12) United States Patent
Brossier et al.

(10) Patent No.: US 9,368,876 B2
(45) Date of Patent: Jun. 14, 2016

(54) IN-SERVICE RECONFIGURABLE ANTENNA REFLECTOR

(71) Applicants: THALES, Neuilly-sur-Seine (FR); CENTRE NATIONAL D'ETUDE SPATIALES (CNES), Paris (FR)

(72) Inventors: Jerome Brossier, Fonsorbes (FR); Ludovic Schreider, Toulouse (FR); Serge Depeyre, Blagnac (FR); Victorien Belloeil, Bourg Saint Bernard (FR); Leri Datashvili, Garching (DE)

(73) Assignees: Thales, Neuilly sur Seine (FR); Centre National d'Etude Spatiales (CNES), Paris (FR)

( * ) Notice: Subject to any disclaimer, the term of this patent is extended or adjusted under 35 U.S.C. 154(b) by 344 days.

(21) Appl. No.: 13/857,925

(22) Filed: Apr. 5, 2013

(65) Prior Publication Data

US 2013/0265209 A1 Oct. 10, 2013

(30) Foreign Application Priority Data

Apr. 6, 2012 (FR) ..... 12 01036

(51) Int. Cl.

| | |
|---|---|
| ***H01Q 15/20*** | (2006.01) |
| ***H01Q 15/14*** | (2006.01) |
| ***H01Q 1/28*** | (2006.01) |
| ***H01Q 15/16*** | (2006.01) |

(52) U.S. Cl.

CPC ..... *H01Q 15/147* (2013.01); *H01Q 1/288* (2013.01); *H01Q 15/161* (2013.01); *H01Q 15/168* (2013.01)

(58) Field of Classification Search

CPC ... H01Q 1/288; H01Q 15/147; H01Q 15/161; H01Q 15/168

USPC ..... 343/822, 915, 912

See application file for complete search history.

(56) References Cited

U.S. PATENT DOCUMENTS

| | | | | |
|---|---|---|---|---|
| 4,750,002 | A | 6/1988 | Kommineni | |
| 5,440,320 | A | 8/1995 | Lach et al. | |
| 2013/0076590 | A1 * | 3/2013 | Baudasse et al. | 343/915 |

FOREIGN PATENT DOCUMENTS

| | | | |
|---|---|---|---|
| EP | 0519775 | A1 | 12/1992 |
| JP | 7249934 | A1 | 9/1995 |

* cited by examiner

*Primary Examiner* — Dieu H Duong
(74) *Attorney, Agent, or Firm* — Baker Hostetler LLP

(57) ABSTRACT

The present invention relates to an in-service reconfigurable antenna reflector comprising a rigid support and a membrane, deformable and having radio-electric reflectivity properties. According to the invention, the reflector comprises a plurality of coupling means connecting the rigid support and the membrane, comprising a first link of finger ball joint type connected to the rigid support, and a second link of finger ball joint type connected to the membrane. Each coupling means furthermore comprises a linear actuator, comprising a rotary motor and a screw-nut assembly, connected to the two links of finger ball joint type, and able to generate, in an operational configuration, a translational motion allowing the deformation of the membrane.

20 Claims, 5 Drawing Sheets

IN-SERVICE RECONFIGURABLE ANTENNA REFLECTOR

CROSS-REFERENCE TO RELATED APPLICATION

Figure 1:
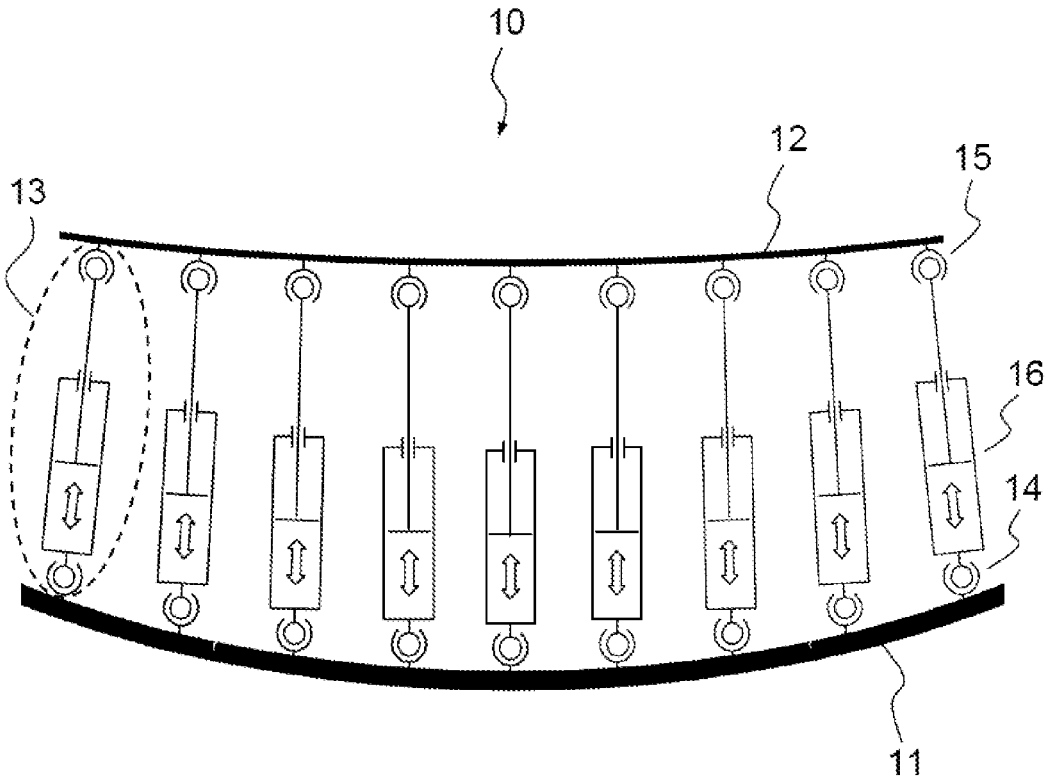

This application claims priority to foreign French patent application No. FR 1201036, filed on Apr. 6, 2012, the disclosure of which is incorporated by reference in its entirety.

FIELD OF THE INVENTION

The present invention relates to the field of in-service reconfigurable antenna reflectors, for example in the case of an antenna for emitting and/or receiving an electromagnetic wave beam, mounted on a spacecraft such as a satellite, and whose zone of coverage it is desired to be able to modify while in orbit. More particularly, the invention concerns the field of Ku-band satellite telecommunications.

BACKGROUND

The increasing lifetime of telecommunication satellites and the growing requirements associated with the various missions entail the development of new generations of satellites, an objective of which is to improve the flexibility of missions. Such is the case notably for telecommunications antennas and their associated mechanisms, for which one seeks for example to be able to choose between several zones of coverage and several frequency bands, and thus afford the possibility of modifying the satellite's missions while in orbit.

A telecommunications satellite comprises at least one antenna allowing the emission and the reception of electromagnetic waves. Each antenna comprises at least one reflector whose shape and orientation determine the terrestrial zone covered by the antenna. With the aim of covering several distinct terrestrial zones or a more extensive terrestrial zone than that which can be covered by a single antenna, it is envisaged to implement an antenna reflector whose reflecting surface is deformable.

Various devices allowing the deformation of the reflecting surface of an antenna are envisaged. In a known implementation of an in-service reconfigurable antenna reflector, a deformable reflecting membrane is positioned on a rigid antenna structure, by means of several linear actuators positioned transversely between the rigid structure and the reflecting membrane, and distributed in a substantially uniform manner over the surface of the membrane. Flexibility of coverage is obtained by elastic deformation of the reflecting membrane during a reconfiguration step achievable in orbit.

In this implementation, the linear actuators, fixed on the rigid structure, are connected to the reflecting membrane at various contact points. A translational motion generated by the linear actuator, for example by means of a ram, is transmitted to the reflecting membrane so as to deform its surface and thus reconfigure the zone of coverage of the antenna.

With the aim of ensuring sufficient holding of the membrane to make it possible to withstand high mechanical stresses, notably the vibratory stresses encountered during a launch phase using a launcher spacecraft, it is envisaged to fix the membrane on the rigid structure at the periphery of its surface; holding the membrane on the structure at the periphery does not allow control of the edges of the membrane.

A first difficulty in this implementation pertains to the mechanical stresses undergone by the membrane at these various points of contact with the linear actuators. Indeed, the linear actuators, which do not allow motion of the membrane in a plane tangential to its surface at their contact point, generate a local mechanical stress on the membrane. This local mechanical stress might not be withstood by the membrane and may engender radial loads on the actuators, and may be particularly penalizing in certain situations, such as for example during a satellite launch phase or during large thermal variations in use in orbit.

A second difficulty encountered in this implementation pertains to the global isostatic holding of the membrane with respect to the rigid structure in order to avoid deformation stresses due to hyperstaticity.

The choice of the materials for the reflecting membrane is in practice limited to a few materials able to withstand all these mechanical stresses. Other materials, which are more attractive in terms of reflectivity performance, mass or cost, are discarded because of their fragility.

SUMMARY OF THE INVENTION

The invention is aimed at proposing an alternative solution for antenna reflector reconfiguration, alleviating the implementation difficulties cited hereinabove.

For this purpose, the subject of the invention is an in-service reconfigurable antenna reflector, adapted for reflecting a beam of electromagnetic waves, comprising a rigid support and a membrane, deformable and having radio-electric reflectivity properties, characterized in that it comprises a plurality of coupling means connecting the rigid support and the membrane, which are distributed under the surface of the membrane, comprising a first link of finger ball joint type connected to the rigid support, and a second link of finger ball joint type connected to the membrane, and in that each coupling means furthermore comprises a linear actuator, comprising a rotary motor and a screw-nut assembly, connected to the two links of finger ball joint type, and able to generate, in an operational configuration, a translational motion allowing the deformation of the membrane.

The invention makes it possible notably to reduce the hyperstaticity of the link between the membrane and the rigid support. The invention makes it possible to reduce the mechanical stresses imposed on the membrane, it becomes possible to implement more fragile materials. By disposing a plurality of coupling means at the periphery of the surface of the membrane, the invention allows precise reconfiguration over the whole of the surface, making it possible notably to optimize the cross polarization generated by the antenna and also the sidelobes.

Although the invention is aimed first and foremost at an application in the field of antenna reflectors for Ku band for a satellite with a geostationary orbit, it is understood that it may apply more generally to any other application implementing an antenna reflector, notably for a space vehicle with a non-geostationary orbit, for which flexibility of coverage is sought.

BRIEF DESCRIPTION OF THE ACCOMPANYING DRAWINGS

The invention will be better understood and other advantages will become apparent on reading the detailed description of the embodiments given by way of example in the following figures.

Figure 2A:
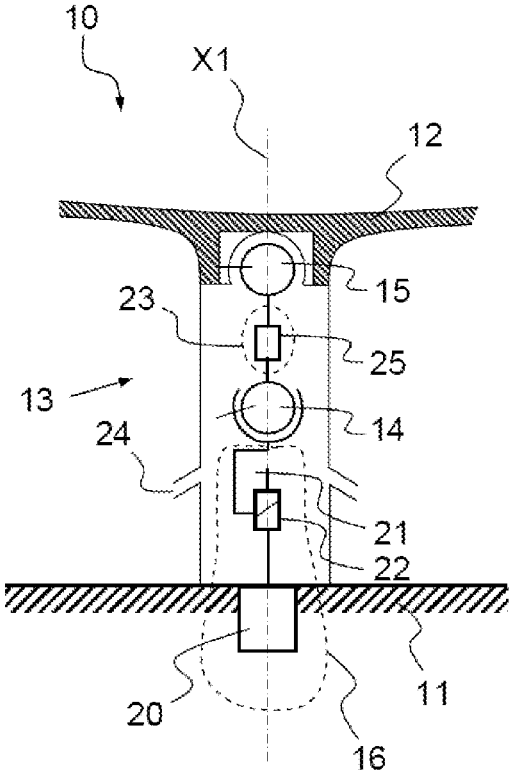
Figure 2B:
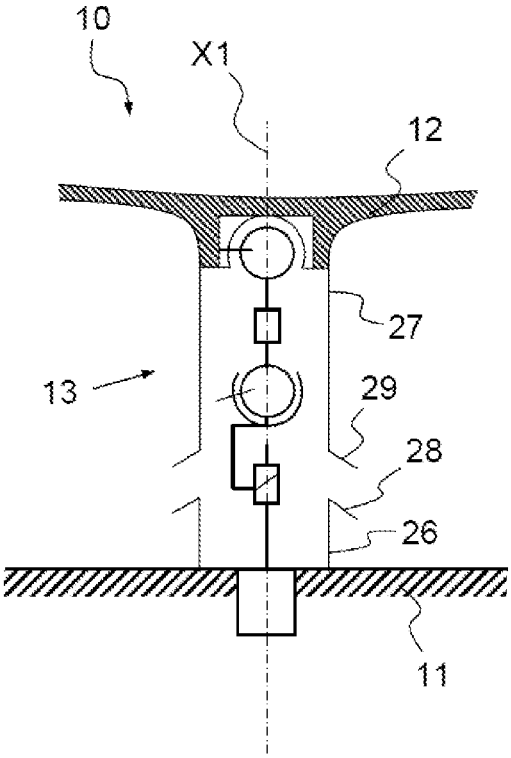
Figure 3A:
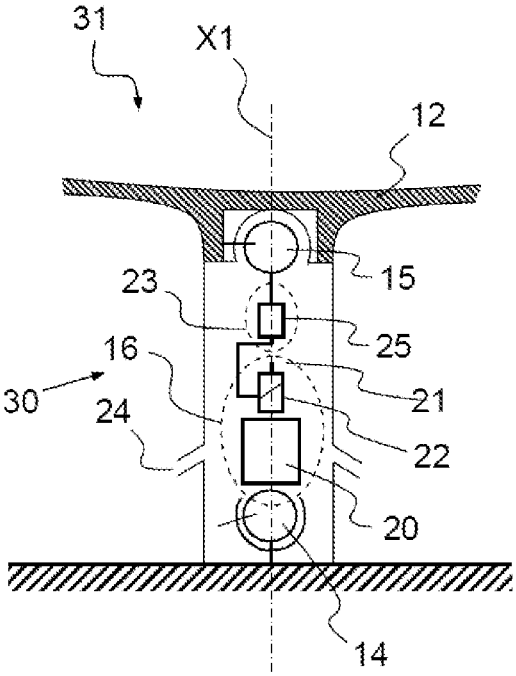
Figure 3B:
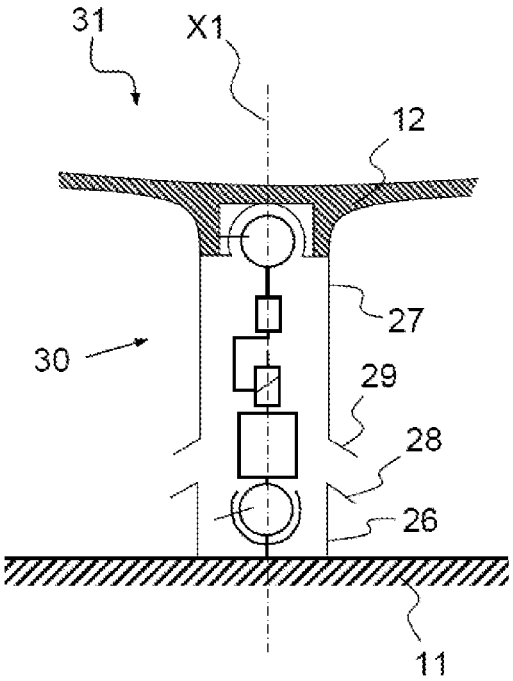
Figure 4A:
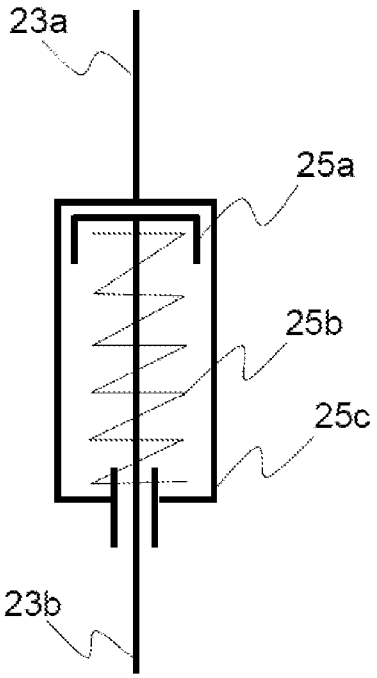
Figure 4B:
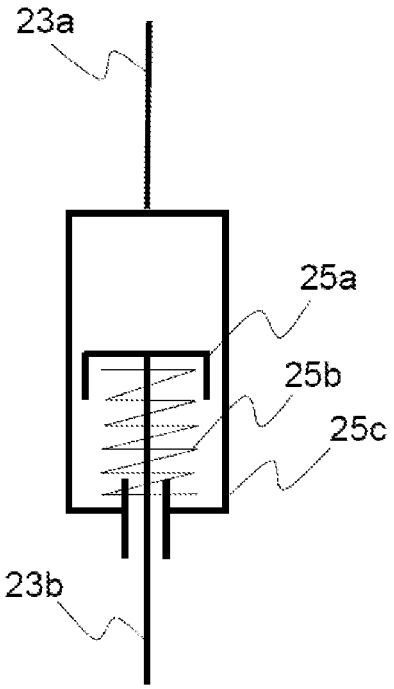
Figure 4C:
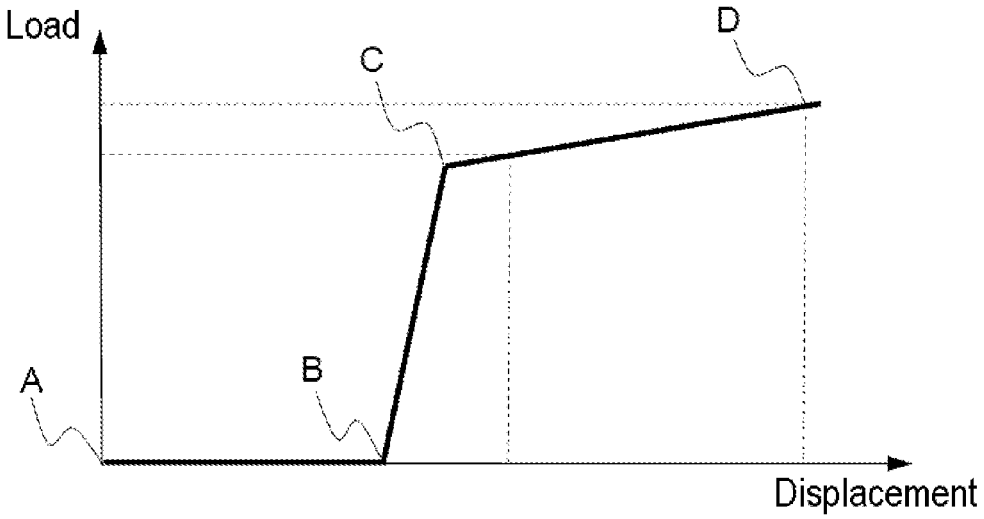
Figure 5A:
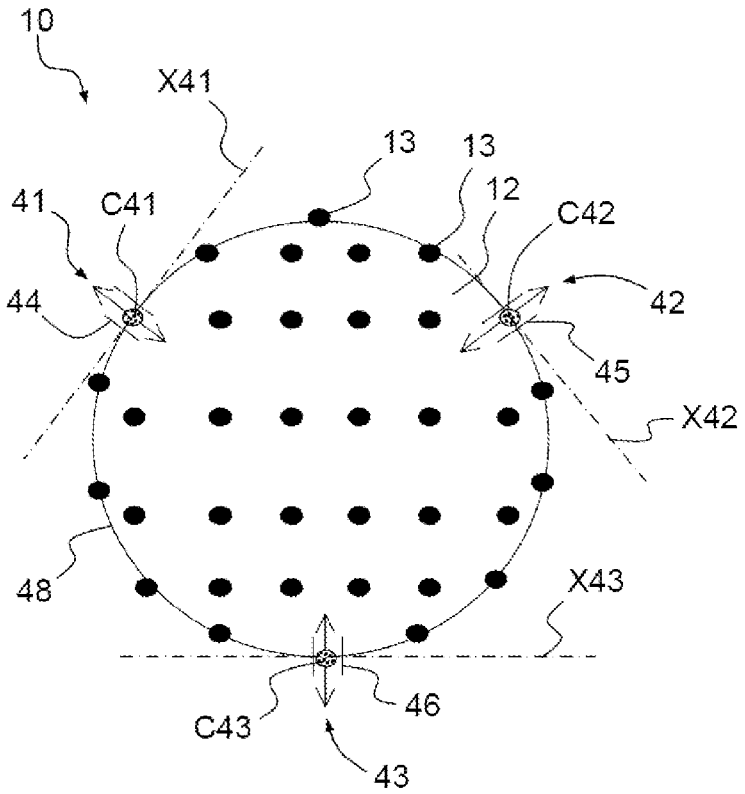
Figure 5B:
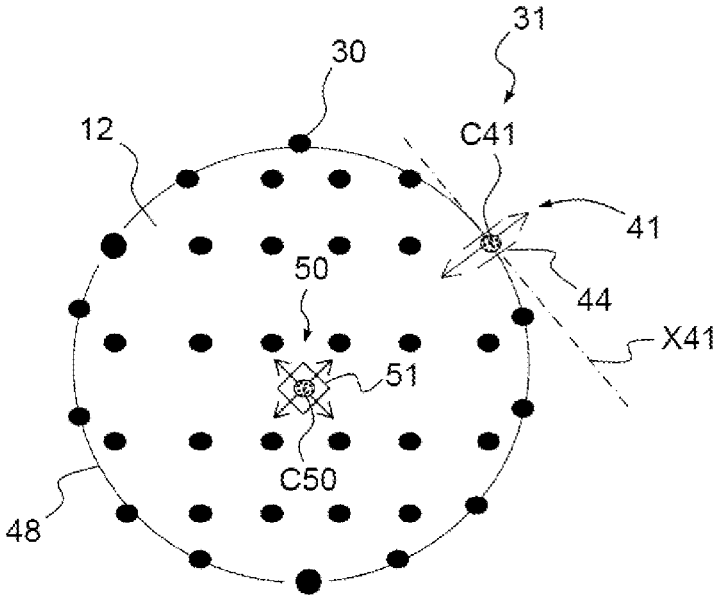
Figure 6A:
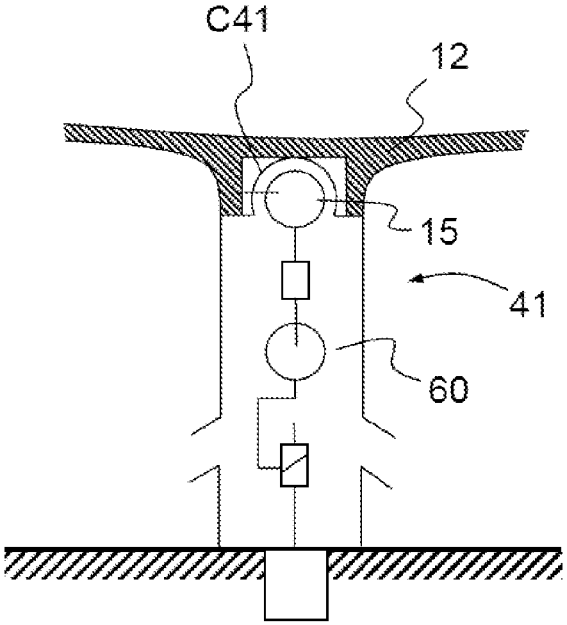
Figure 6B:
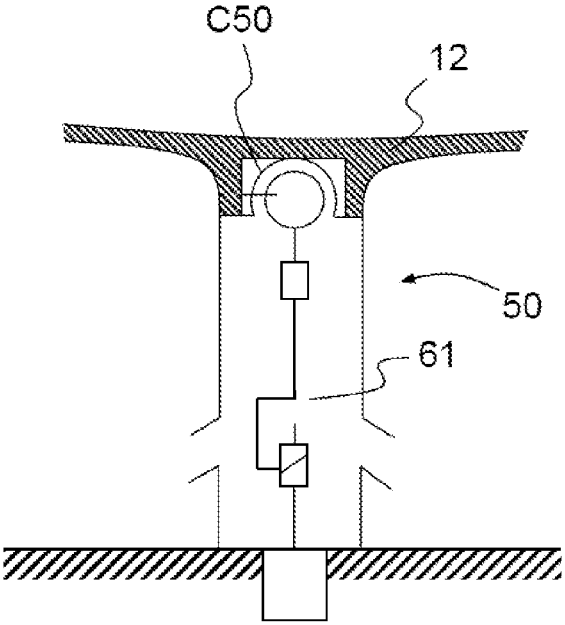

FIG. 1 represents a basic diagram of an in-service reconfigurable antenna reflector, comprising a rigid support, a membrane and coupling means, FIGS. 2.*a* and 2.*b* represent a means of coupling of an antenna reflector according to a first embodiment, in a storage configuration (2.*a*) and in an operational configuration (2.*b*), FIGS. 3.*a* and 3.*b* represent a means of coupling of an antenna reflector according to a second embodiment, in a storage configuration (3.*a*) and in an operational configuration (3.*b*), FIGS. 4.*a*, 4.*b* and 4.*c* illustrate the principle of a load limiter in a preferred embodiment of the invention, FIGS. 5.*a* and 5.*b* represent viewed from above an antenna reflector according to two variants of the invention, FIGS. 6.*a* and 6.*b* describe respectively a peripheral coupler and a central coupler in a favoured embodiment of the invention.

For the sake of clarity, the same elements will bear the same labels in the various figures.

DETAILED DESCRIPTION

FIG. 1 represents a basic diagram of an antenna reflector 10 comprising a rigid support 11 and a membrane 12, deformable and having radio-electric reflectivity properties. The antenna reflector 10 furthermore comprises a plurality of coupling means 13 connecting the rigid support 11 and the membrane 12. The coupling means 13 are distributed under the surface of the membrane 12.

Each of the coupling means 13 comprises a first link of finger ball joint type 14 connected to the rigid support 11 and a second link of finger ball joint type 15 connected to the membrane 12. The expression link of finger ball joint type is intended to mean a mechanical link locked in translation and possessing two degrees of freedom in rotation.

Each of the coupling means 13 furthermore comprises a linear actuator 16, connected to the two links of finger ball joint type 14 and 15, and able to generate, in an operational configuration, a translational motion allowing the deformation of the membrane 12.

Advantageously, the rigid support 11 and the membrane 12 are of substantially parabolic shape, making it possible to maintain a substantially constant distance between the rigid support 11 and the membrane 12 on the surface of the membrane 12. Thus, the coupling means 13 distributed over the surface of the membrane 12 are of substantially equivalent length. It is possible to use for these coupling means the same components and therefore to simplify the implementation and to lower the cost of a reconfigurable antenna such as this.

Advantageously, the distribution of the coupling means 13 may be substantially uniform over the surface of the membrane 12. In a first embodiment, the coupling means 13 are distributed under the surface of the membrane 12 according to a square mesh or according to a hexagonal mesh. In a second embodiment, a density distribution which is substantially different between the centre of the surface and its periphery is adopted, so as to increase the precision of the surface reconfiguration in a predetermined zone of the reflector.

FIGS. 2.*a* and 2.*b* represent one of the coupling means 13 of the antenna reflector 10 according to a first embodiment of the invention, in a storage configuration in FIG. 2.*a*, and in an operational configuration in FIG. 2.*b*.

Storage configuration, often also called stacking configuration, refers to the configuration of a satellite platform and of its equipment that makes it possible to hold all the equipment stationary against the platform, in particular during a launch phase using a launcher spacecraft. In the operational configuration, often also called the unstacked configuration, the equipment is released and positioned so as to allow it to operate and participate in the satellite's missions.

The axis of translation of the linear actuator 16 is labelled X1 in FIGS. 2.*a* and 2.*b*. The linear actuator 16 of each of the coupling means 13 comprises a rotary motor 20 and a screw 21-nut 22 assembly, which are connected to the two links of finger ball joint type 14 and 15, and able to generate, in an operational configuration, a translational motion allowing the deformation of the membrane 12.

Indeed, the rotary motor 20 drives the screw 21 in rotation in relation to the axis X1. The nut 22 is locked in rotation by the two links of finger ball joint type 14 which are connected to it. Thus, the body 27 tied to the membrane 12 forms together with the nut 22 an assembly tied in rotation in relation to the axis X1. The rotational motion of the screw 21 therefore drives the nut 22 and the first link of finger ball joint type 14 in translation.

More generally, the two embodiments, described by FIGS. 2.*a*, 2.*b*, 3.*a* and 3.*b*, implementing two links of finger ball joint type and a rotary motor, are particularly advantageous with respect to the known solutions. This mounting indeed makes it possible to reconfigure the surface of the membrane 12 by means of a translational motion, while limiting the local mechanical stresses on the membrane 12 at its point of contact with the coupling means 13. This implementation permits the translational motion of the membrane 12 tangentially to its surface at this point and the rotational motions about along the axes perpendicular to X1. Thus, the membrane 12, deformed at several points of contact by the coupling means 13, can move tangentially to its surface at these various points of contact, making it possible to limit the mechanical stresses on the membrane 12 at these contact points.

The implementation of the two links of finger ball joint type thus makes it possible to appreciably limit the hyperstatism of the link between the rigid support 11 and the membrane 12.

In this first embodiment, described in FIGS. 2.*a* and 2.*b*, each of the coupling means 13 comprises several components connected together, and positioned in series between the rigid structure 11 and the membrane 12 in the following order:

- the rotary motor 20, fixed on the rigid structure 11,
- the screw 21 cooperating with the nut 22,
- the first link of finger ball joint type 14,
- a rod 23,
- the second link of finger ball joint type 15, fixed on the membrane 12.

The rotary motor 20 is fixed on the rigid structure 11. For bulkiness reasons, it may be embedded in the rigid structure 11, as represented in FIGS. 2.*a* and 2.*b*. This mounting makes it possible advantageously to simplify the electrical power feed to the coupling means 13 by holding this power feed stationary on the rigid structure 11.

The rod 23 is connected at each of these two ends to one of the links of finger ball joint type 14 and 15. The translational motion generated by the linear actuator 16 is transmitted to the membrane 12 by means of the rod 23 and the two finger ball joints 14 and 15. The proposed implementation thus allows the deformation of the membrane 12, by translation along the axis X1, while permitting the motion of the membrane 12 tangentially to its surface; making it possible to limit the mechanical stresses generated locally at the point of contact of the coupling means 13 with the membrane 12.

FIG. 2.*a* represents the coupling means 13 in the storage configuration. FIG. 2.*b* represents the coupling means 13 in the operational configuration.

Advantageously, each of the coupling means 13 comprises a mechanical abutment 24, making it possible to immobilize, by means of the linear actuator 16, the membrane 12 with respect to the rigid support 11, in a storage configuration.

Advantageously, the rod 23 comprises between these two ends a load limiter 25 actuated in the storage configuration by means of the linear actuator 16, exerting a load on the mechanical abutment 24 so as to immobilize the membrane 12 with respect to the rigid support 11. The load limiter 25 is able, in the operational configuration, to transmit without deformation the translational motion generated by the linear actuator 16.

Advantageously, the rod 23 and the two links of finger ball joint type 14 and 15 are composed of a composite material based on carbon fibre. This type of material possesses notably the advantage of being robust, lightweight and of exhibiting a very low thermal expansion coefficient.

Advantageously, each of the coupling means 13 comprises two tubular bodies 26 and 27. The first tubular body 26 is fixed by a first end to the rigid support 11 and exhibits a conical rim 28 at a second end. The second tubular body 27 is fixed by a first end to the membrane 12 and exhibits a conical rim 29 at a second end. The two conical rims 28 and 29 are able, in the storage configuration, to come into contact with one another to form the mechanical abutment or stacking abutment 24.

In the storage configuration, the two conical rims 28 and 29 are in abutment one against the other and the rotary motor 20 pulls on the rod 23 until actuation of the load limiter 25. In the storage configuration, the load limiter constantly applies a load making it possible to hold the two conical rims 28 and 29 in abutment one against the other, even when the rotary motor 20 is not in operation. This load makes it possible to immobilize the membrane 12 with respect to the rigid support 11, even in the case of strong vibrations as encountered during a satellite launch phase. Thus, the proposed implementation makes it possible in a simple way to immobilize the membrane in relation to the three axes of translation by means of the load limiter 25 and the two conical rims 28 and 29.

Advantageously, the two tubular bodies 26 and 27 comprise a composite material based on carbon fibre. This type of material possesses notably the advantage of being robust, lightweight and of exhibiting a very low thermal expansion coefficient. This implementation makes it possible, in the storage configuration, to hold the membrane 12 secured to the rigid support 11, and thus to protect it from the strong vibratory stresses encountered notably during a satellite launch phase.

Advantageously, the links of finger ball joint type are embodied by means of an assembly of deformable fibres. The assembly of deformable fibres is able to accept deformations in relation to rotation axes perpendicular to the axis X1, and to limit substantially any rotation in relation to the axis X1.

FIGS. 3.*a* and 3.*b* represent a means of coupling 30 of an antenna reflector 31 according to a second embodiment of the invention, in a storage configuration (3.*a*) and in an operational configuration (3.*b*).

The antenna reflector 31 comprises the rigid support 11, the membrane 12 and coupling means 30. The coupling means 30 comprise the same components as the coupling means 13, which will bear the same names for convenience.

In this second embodiment, each of the coupling means 30 comprises several components connected together, and positioned in series between the rigid structure 11 and the membrane 12 in the following order:

- the first link of finger ball joint type 14, fixed on the rigid structure 11,
- the rotary motor 20,
- the screw 21 cooperating with the nut 22,
- the rod 23,
- the second link of finger ball joint type 15, fixed on the membrane 12.

Advantageously, the rotary motor 20 and the screw 21-nut 22 assembly are positioned between the two links of finger ball joint type 14 and 15. Thus, the axis of translation X1 of the storage means 30 can be mobile during a reconfiguration of the antenna. This implementation is particularly advantageous since it makes it possible to limit the stresses on the membrane 12, and therefore to limit the load of the rotary motor 20. This implementation also makes it possible to increase the amplitude of a possible translation of the membrane 12 in a plane tangential to the surface.

FIGS. 4.*a*, 4.*b* and 4.*c* illustrate the principle of a load limiter in a preferred embodiment of the invention.

The load limiter 25 comprises a piston 25*a*, a spring 25*b* and a chamber 25*c*. The piston 25*a* is capable of moving in translation in the chamber 25*c* along the axis X1. The piston 25*a* is held in the operational configuration in contact with the chamber 25*c* by means of a spring 25*b*, bearing on the one hand against the piston 25*a* and on the other hand against the chamber 25*c*.

The chamber 25*c* is connected to the second link of finger ball joint type 15 by means of a first rigid element 23*a* of the rod 23. The piston 25*a* is connected to the first link of finger ball joint type 14 by means of a second rigid element 23*b* of the rod 23.

In the operational configuration represented in FIG. 4.*a*, the rod 23, comprising the load limiter 25 and the rigid elements 23*a* and 23*b*, is rigid without elastic deformation of the load limiter 25. In the storage configuration, an elastic deformation of the limiter 25 is obtained by means of a traction of the linear actuator 16 on the rigid element 23*b*, causing a squashing of the spring 25*b* by translation of the piston 25*a* in the chamber 25*c*. This squashing of the spring 25*b* takes place when the bodies 26 and 27 are in abutment and when the linear actuator 16 exerts a load greater than the initial gauge loading of the spring 25*b*. Stated otherwise, in the storage configuration, the linear actuator 16 exerts on the piston 25*a* a traction load able to compress the spring 25*b* and detach the piston 25*a* from the chamber 25*c*.

The load holding the membrane 12 on the rigid structure 11, also called the stacking load, is at the minimum equal to the gauge load of the spring 25*b*.

This principle is also described in FIG. 4.*c*. In the operational configuration, the linear actuator 16 is free to effect a translation between the point A and the point B. When the bodies 26 and 27 enter into mechanical abutment, represented by the point B, a significant load must be provided by the linear actuator 16 in order to detach the piston 25*a* from the chamber 25*c*. This load represented by the point C corresponds to the initial gauge loading of the spring 25*b*. The segment connecting the point C to the point D is substantially vertical, the slope represented in the figure corresponds to the stiffness of the rod 23. Between the points C and D, the load limiter 25 is said to be actuated; it imposes, over a range corresponding to the amplitude of the displacement of the piston 25*a* inside the chamber 25*c*, a relatively invariable load, dependent on the stiffness of the spring 25*b*.

This embodiment is particularly advantageous, since it makes it possible to maintain a substantially constant load, for a sufficiently high mean value, over an appreciable range of displacement. With no load limiter, the stacking loads are very high and of such a nature as to damage the actuator 16.

In an alternative embodiment, not represented in FIGS. 4.*a*, 4.*b* and 4.*c*, the load limiter 25 comprises a helical spring whose turns remain adjoining in the operational configuration. The rod 23 remains rigid without elastic deformation of the load limiter 25. When the bodies 26 and 27 are in abutment and the linear actuator 16 exerts a load greater than the gauge loading of the helical spring, the turns of the helical spring detach and opposes beyond this gauging load, a relatively invariable load over an appreciable range of displacement.

FIG. 5.*a* represents viewed from above an antenna reflector 10 in a first variant of the invention.

FIG. 5.*a* describes an implementation of an antenna reflector 10 comprising a plurality of coupling means 13 such as were defined previously. However it is understood that this variant of the invention applies in the same manner in the case of an antenna reflector 31 comprising a plurality of coupling means 30 such as were defined previously.

In this variant, the antenna reflector 10 comprises three coupling means 13, termed peripheral couplers, labelled 41, 42 and 43, positioned in proximity to the periphery, labelled 48, of the membrane 12. The peripheral couplers 41, 42 and 43 are substantially positioned at equal distances between themselves.

The point of contact between the membrane and each of the peripheral couplers 41, 42 and 43 is labelled respectively C41, C42 and C43.

The axis tangential to the periphery of the membrane at each of the contact points C41, C42 and C43 is labelled respectively X41, X42 and X43.

Each of the three peripheral couplers 41, 42 and 43 comprises means 44, 45 and 46 able to prohibit the motion of the membrane 12 along the tangential axis X41, X42 and X43. The motion of the membrane 12 remains free along an axis perpendicular to the tangential axis.

This implementation is particularly advantageous since it makes it possible by means of the three peripheral couplers 41, 42 and 43 to hold the membrane 12 in an isostatic manner on the rigid structure 11 in the operational configuration. This implementation is particularly advantageous with respect to the known solutions which envisage fixing the membrane 12 on the rigid support 11 at its periphery. The proposed implementation circumvents the difficulties of the known solutions, and allows deformations of the surface at the periphery of the membrane 12 so as to control the cross polarization and the sidelobes generated by the antenna. Thus, the rigid support and the membrane are connected solely by the plurality of coupling means. Stated otherwise, in contradistinction to the known solutions, the membrane is not fixed to the rigid support at its periphery.

FIG. 5.*b* is a view from above of the antenna reflector 10 in a second variant of the invention.

FIG. 5.*b* describes an implementation of an antenna reflector 10 comprising a plurality of coupling means 13 such as were defined previously. However, it is understood that this variant of the invention applies in the same manner in the case of an antenna reflector 31 comprising a plurality of coupling means 30 such as were defined previously.

In this second variant, the antenna reflector 10 comprises:

- a coupling means, termed the central coupler, labelled 50, positioned at the centre of the membrane 12 and comprising means 51 able to prohibit the motion of the membrane 12 in the plane tangential to the surface of the membrane 12 at a point of contact C50 between the central coupler 50 and the membrane 12,
- a peripheral coupler 41 comprising the means 44 able to prohibit the motion of the membrane 12 along the tangential axis X41.

This implementation is particularly advantageous since it makes it possible, by means of two specific coupling means, 41 and 50, to hold the membrane 12 in an isostatic manner on the rigid structure 11 in the operational configuration.

FIGS. 6.*a* and 6.*b* respectively describe a peripheral coupler 41 and a central coupler 50 in a favoured embodiment of the invention.

It is understood that the embodiment described in FIG. 6.*a*, implementing a peripheral coupler 41, also applies in respect of a peripheral coupler 42 or 43.

The peripheral couplers 41, 42 and 43 and the central coupler 50 are similar to the coupling means 13 or 30 such as defined in FIGS. 2.*a*, 2.*b*, 3.*a* and 3.*b* but do not comprise the first link of finger ball joint type 14.

Advantageously, the peripheral couplers 41, 42 and 43 comprise a pivot link 60, in place of the first link of finger ball joint type 14, whose free rotation axis is substantially parallel to their axis X41, X42 and X43 tangential to the periphery 48 of the membrane 12, so as to prohibit the motion of the membrane 12 in relation to this axis.

Advantageously, the central coupler 50 comprises a complete link 61, in place of the first link of finger ball joint type 14, so as to prohibit the motion of the membrane 12 tangentially to its surface.

The implementation of the antenna reflector according to the invention makes it possible to considerably minimize the mechanical stresses on the membrane 12. Advantageously, the membrane 12 comprises at least one material of enhanced conducting elastomer type, of carbon fibre fabric type covered with a silicone layer and filled with particles of metal or of carbon, or of metallic fabric type shrouded in a metal or carbon particle-filled silicone. These three materials exhibit excellent reflectivity properties in the Ku band.

The invention claimed is:

1. An in-service reconfigurable antenna reflector, adapted for reflecting a beam of electromagnetic waves, comprising a rigid support and a membrane, deformable and having radioelectric reflectivity properties, and comprising:

- a plurality of coupling means connecting the rigid support and the membrane, which are distributed over the surface of the membrane, comprising a first link of finger ball joint type connected to the rigid support, and a second link of finger ball joint type connected to the membrane, and
- each coupling means further comprising a linear actuator, comprising a rotary motor and a screw-nut assembly, connected to the two links of finger ball joint type, and able to generate, in an operational configuration, a translational motion allowing the deformation of the membrane;
- the membrane not being fixed to the rigid support at its periphery.

2. The antenna reflector according to claim 1, wherein each coupling means comprises several components connected together, and positioned in series between the rigid structure and the membrane in the following order:

- the rotary motor, fixed on the rigid structure,
- the screw cooperating with the nut,
- the first link of finger ball joint type,
- a rod,
- the second link of finger ball joint type, fixed on the membrane.

3. The antenna reflector according to claim 1, wherein each coupling means comprises components connected together, and positioned in series between the rigid structure and the membrane in the following order:

- the first link of finger ball joint type, fixed on the rigid structure,
- the rotary motor,
- the screw cooperating with the nut,
- a rod, the second link of finger ball joint type, fixed on the membrane.

4. The antenna reflector according to claim 1, wherein each of the coupling means comprises a mechanical abutment, making it possible to immobilize, by means of the linear actuator, the membrane with respect to the rigid support, in a storage configuration.

5. The antenna reflector according to claim 4, wherein each of the coupling means comprises a load limiter actuated in the storage configuration by means of the linear actuator;

the load limiter exerting a load on the mechanical abutment so as to immobilize the membrane with respect to the rigid support;

the load limiter being able, in the operational configuration, to transmit without deformation the translational motion generated by the linear actuator.

6. The antenna reflector according to claim 5, wherein the load limiter comprises a piston, a chamber and a spring;

the piston being capable of moving in translation in the chamber along an axis, and in that the piston is held in the operational configuration in contact with the chamber by means of the spring, and in that in the storage configuration, the linear actuator exerts on the piston a traction load able to compress the spring and detach the piston from the chamber.

7. The antenna reflector according to claim 4, wherein each of the coupling means comprises a first tubular body, fixed by a first of its ends to the rigid support and exhibiting a conical rim at a second of its ends, and a second tubular body, fixed by a first of its ends to the membrane and exhibiting a conical rim at a second of its ends, and the two conical rims are able, in the storage configuration, to come into contact with one another to form the mechanical abutment.

8. The antenna reflector according to claim 7, wherein the two tubular bodies comprise a composite material based on carbon fibre.

9. The antenna reflector according to claim 1, comprising at least three coupling means, termed peripheral couplers positioned in proximity to the periphery of the membrane and substantially positioned at equal distances between themselves, and each of the peripheral couplers comprises means for prohibiting the motion of the membrane along an axis tangential to the periphery of the membrane at a point of contact between the peripheral coupler and the membrane.

10. The antenna reflector according to claim 9, wherein the means for prohibiting the motion of the membrane along the axis tangential to the periphery of the membrane at a respective point of contact between at least one of the peripheral couplers and the membrane includes a pivot link to prohibit a translational motion of the membrane in relation to the axis tangential to the periphery of the membrane, wherein a free rotation axis of the pivot link is substantially parallel to the axis tangential to the periphery of the membrane.

11. The antenna reflector according to claim 1, further comprising:

a coupling means positioned substantially at the centre of the membrane, termed the central coupler, and comprising means for prohibiting the motion of the membrane in the plane tangential to the surface of the membrane at a point of contact between the central coupler and the membrane, a coupling means, termed the peripheral coupler, positioned in proximity to the periphery of the membrane, and comprising means for prohibiting the motion of the membrane along an axis tangential to the periphery of the membrane at a point of contact between the peripheral coupler and the membrane.

12. The antenna reflector according to claim 11, wherein the means for prohibiting the motion of the membrane in the plane tangential to the surface of the membrane at the point of contact between the central coupler and the membrane includes a complete link to prohibit the motion of the membrane tangentially to the surface of the membrane.

13. The antenna reflector according to claim 1, wherein the rigid support and the membrane are of substantially parabolic shape.

14. The antenna reflector according to claim 1, wherein the two links of finger ball joint type comprise a composite material based on carbon fibre.

15. The antenna reflector according to claim 1, wherein the membrane comprises at least one material of enhanced conducting elastomer type, of carbon fibre fabric type covered with a silicone layer and filled with particles of metal or of carbon, or of metallic fabric type shrouded in a metal or carbon particle-filled silicone.

16. The antenna reflector according to claim 1, wherein at least one link of finger ball joint type is embodied by means of an assembly of deformable fibres.

17. The antenna reflector according to claim 1, further comprising at least one peripheral coupler including means for prohibiting motion of the membrane along an axis tangential to the periphery of the membrane, wherein the membrane is free to move along an axis perpendicular to the axis tangential to the periphery of the membrane.

18. An in-service reconfigurable antenna reflector, adapted for reflecting a beam of electromagnetic waves, comprising a rigid support and a membrane, deformable and having radio-electric reflectivity properties, and comprising:

a plurality of coupling means connecting the rigid support and the membrane, which are distributed over the surface of the membrane, comprising a first link of finger ball joint type connected to the rigid support, and a second link of finger ball joint type connected to the membrane, each coupling means further comprising a linear actuator, comprising a rotary motor and a screw-nut assembly, connected to the two links of finger ball joint type, and able to generate, in an operational configuration, a translational motion allowing the deformation of the membrane; and at least one peripheral coupler including means for prohibiting motion of the membrane along an axis tangential to the periphery of the membrane, wherein the membrane is free to move along an axis perpendicular to the axis tangential to the periphery of the membrane.

19. An in-service reconfigurable antenna reflector configured to reflect a beam of electromagnetic waves, the in-service reconfigurable antenna reflector comprising:

a rigid support;

a membrane that is deformable and includes radio-electric reflectivity properties, a plurality of coupling means distributed over a surface of the membrane connecting the rigid support and the membrane, wherein a periphery of the membrane is not fixed to the rigid support, and wherein each of the coupling means includes:

a linear actuator including a rotary motor and a screw-nut assembly connected to a first link of finger ball joint type and a second link of finger ball joint type, the linear actuator configured to generate translational motion of a respective coupling means and deformation of the membrane in an operational configuration, and a mechanical abutment configured to immobilize the membrane with respect to the rigid support in a storage configuration.

20. The in-service reconfigurable antenna reflector of claim 19, further comprising:

at least one peripheral coupler positioned in proximity to the periphery of the membrane and including means for prohibiting motion of the membrane along an axis tangential to the periphery of the membrane, wherein the membrane is free to move along an axis perpendicular to the axis tangential to the periphery of the membrane.

* * * * *